US005743756A

United States Patent [19]

Hasz et al.

[11] Patent Number: 5,743,756

[45] Date of Patent: Apr. 28, 1998

[54] SEALED ELECTRICAL CONNECTOR WITH JACK SCREW

[75] Inventors: Richard Eric Hasz, Ramseur; Gary Ray Marpoe, Jr., Kernersville; Thomas Edward Musser, Greensboro, all of N.C.

[73] Assignee: The Whitaker Corporation, Wilmington, Del.

[21] Appl. No.: 625,466

[22] Filed: Mar. 29, 1996

[51] Int. Cl.[6] ..... H01R 13/627

[52] U.S. Cl. ..... 439/364

[58] Field of Search ..... 439/362–364, 439/595, 587, 589

[56] References Cited

U.S. PATENT DOCUMENTS

| | | | |
|---|---|---|---|
| 3,701,085 | 10/1972 | Graddy et al. . | |
| 3,771,108 | 11/1973 | Haffner et al. . | |
| 3,876,275 | 4/1975 | Clark . | |
| 4,090,764 | 5/1978 | Malsby . | |
| 4,666,325 | 5/1987 | Vantouroux | 403/13 |
| 4,850,896 | 7/1989 | Smith et al. | 439/489 |
| 4,865,560 | 9/1989 | Thomas | 439/341 |
| 5,100,336 | 3/1992 | Burgess et al. | 439/277 |
| 5,139,431 | 8/1992 | Saitoh et al. | 439/364 |
| 5,201,625 | 4/1993 | Takenouchi | 411/369 |
| 5,266,047 | 11/1993 | Black et al. | 439/364 |
| 5,295,756 | 3/1994 | Ohta | 403/407.1 |
| 5,419,714 | 5/1995 | Nagamine | 439/364 |

*Primary Examiner*—Khiem Nguyen
*Attorney, Agent, or Firm*—Bradley N. Ditty

[57] ABSTRACT

A mated assembly (100) includes a sealed connector subassembly (10), a cap housing (20), a contact retention insert (30), a wire seal (40), a seal cover (50), a jack screw (60), and a header housing (70). Jack screw (60) is used to matably join the subassembly (10) with the header (70). Subassembly (10) comprises a cap housing (20) which includes a cavity (23) wherein the contact retention insert (30) is disposed along with a blanket type seal (40) for receiving electrical contacts that will electrically mate with respective pins of contact array (72). The contact retention insert (30) is advantageously connected to the cap housing (20) by way of insert retaining clip (32), and the bolt (60) is free to rotate but is axially trapped within cap housing (20) between washer (61) and bolt retaining clip (63).

20 Claims, 6 Drawing Sheets

SEALED ELECTRICAL CONNECTOR WITH JACK SCREW

The present invention relates to an electrical connector assembly comprising a jack screw for joining matable connector halves of the assembly; more particularly, one of the mating halves comprises a sealed connector subassembly with the jack screw rotatably mounted therein, and a contact retention insert assembled to the housing with an insert retaining clip.

BACKGROUND OF THE INVENTION

Sealed electrical connectors are commonly used in the automotive industry to preserve the electrical connections therein from degradation due to moisture or other contaminants. Individual wire seals are conventionally used for sealing connectors; however, such wire seals are disadvantageous because they are expensive to produce and assemble to respective wires. Alternatively, blanket type wire seals are used to lower the cost of producing sealed electrical connectors. Moreover, jack screws are used with sealed connectors to provide the requisite contact mating forces for mating the connector halves together.

A known electrical connector having a jack screw mating mechanism, and subassemblies with individual wire seals, is disclosed in U.S. Pat. No. 5,201,625 which is hereby incorporated by reference in its entirety. Assembly of the connector requires that individual wire seals are preassembled to respective wires, and then the sealed wire is inserted into a connector housing for electrical interconnection with a matable electrical contact. The housing configuration requires a guillotine type connector latch mechanism for contact retention. This conventional assembly is expensive to produce because it requires many parts and assembly steps in order to make each sealed connection, and is expensive to manufacture because of the guillotine type contact retention feature and assembly steps appurtenant thereto.

In light of the above problems, what is needed is an electrical connector that advantageously: combines the advantages inherent in a blanket type seal with a jack screw connector mating mechanism; securely retains electrical contacts; provides mechanical and electrical reliability of the electrical interconnections in the connector; is inexpensive to produce; and uses a minimum number of parts which can be quickly assembled with quality and reliability assured in the final product.

SUMMARY OF THE INVENTION

The foregoing advantages are achieved by the present invention which essentially comprises an electrical connector subassembly having: (a) a housing for receiving a contact retention insert, and the housing includes a tower section; (b) a contact retention insert, the retention insert comprises at least one electrical contact receiving cavity therein, and the retention insert comprises an aperture, the tower extends through the aperture; and (c) a retaining part is mounted adjacent to the contact retention insert, and a section of the retaining part bites into a portion of the tower for retaining the contact retention insert with the housing.

The retaining part comprises an annular ring formed of a spring grade metallic material, and the retaining part comprises detents for biting into the tower. The contact retention insert comprises a recess which receives the retaining part therein, and the recess includes a bearing surface for supporting the retaining part therein.

The tower comprises a fastener retaining member in a recess thereof, and the fastener retaining member is disposed radially inwardly relative to the retaining part. Additionally, the tower comprises a fastener sealing member in a recess thereof wherein the fastener sealing member is disposed radially inwardly relative to the retaining part.

DETAILED DESCRIPTION OF THE INVENTION

Figure 1:
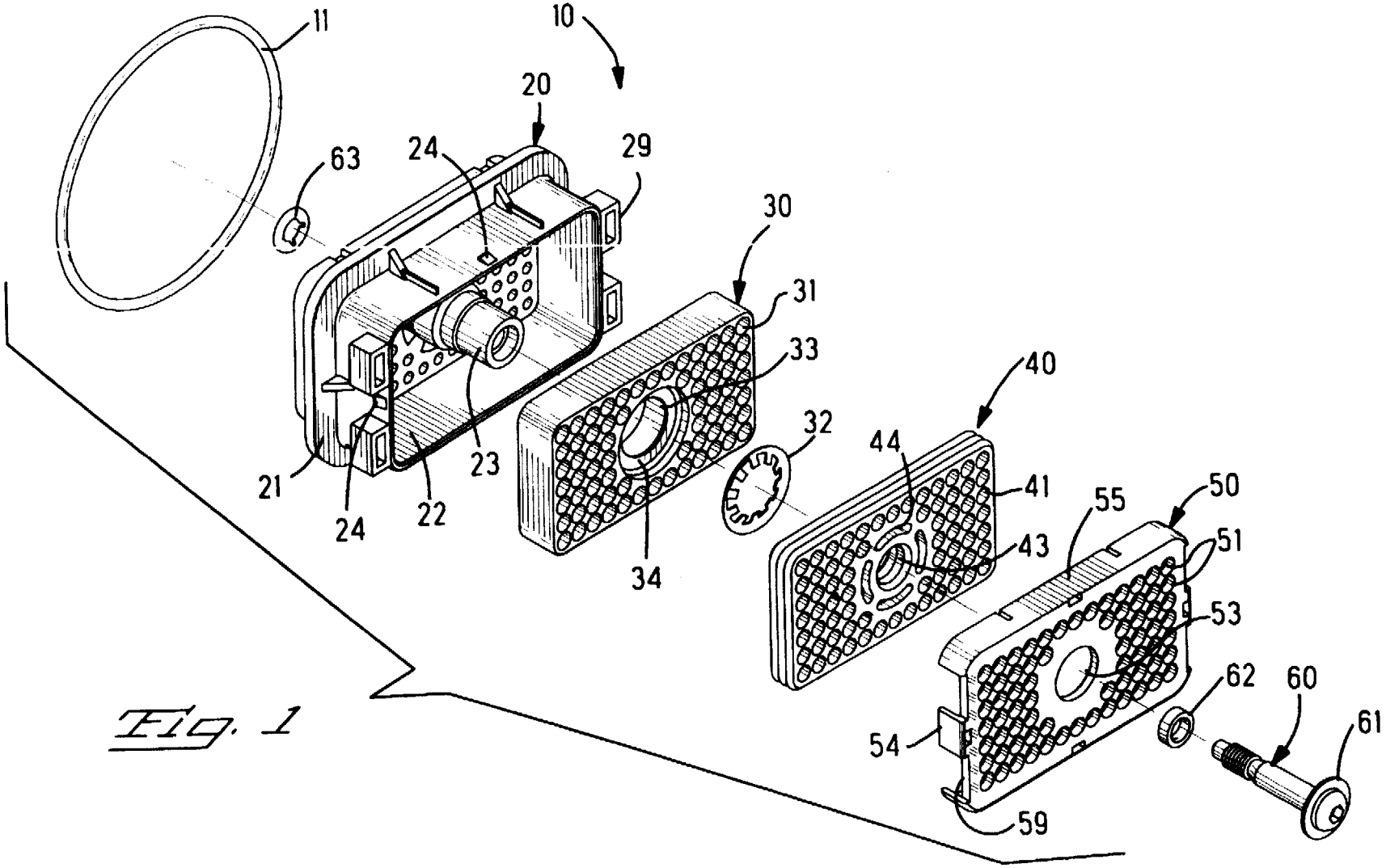
FIG. 1 shows an exploded isometric view of a connector subassembly according to the present invention.

Referring to FIG. 1, the sealed connector subassembly 10 of the present invention will be described. Sealed connector subassembly 10 comprises an interface seal 11, a plug housing 20, a contact retention insert 30, a wire seal 40, a seal cover 50, and a jack screw 60.

Figure 2:
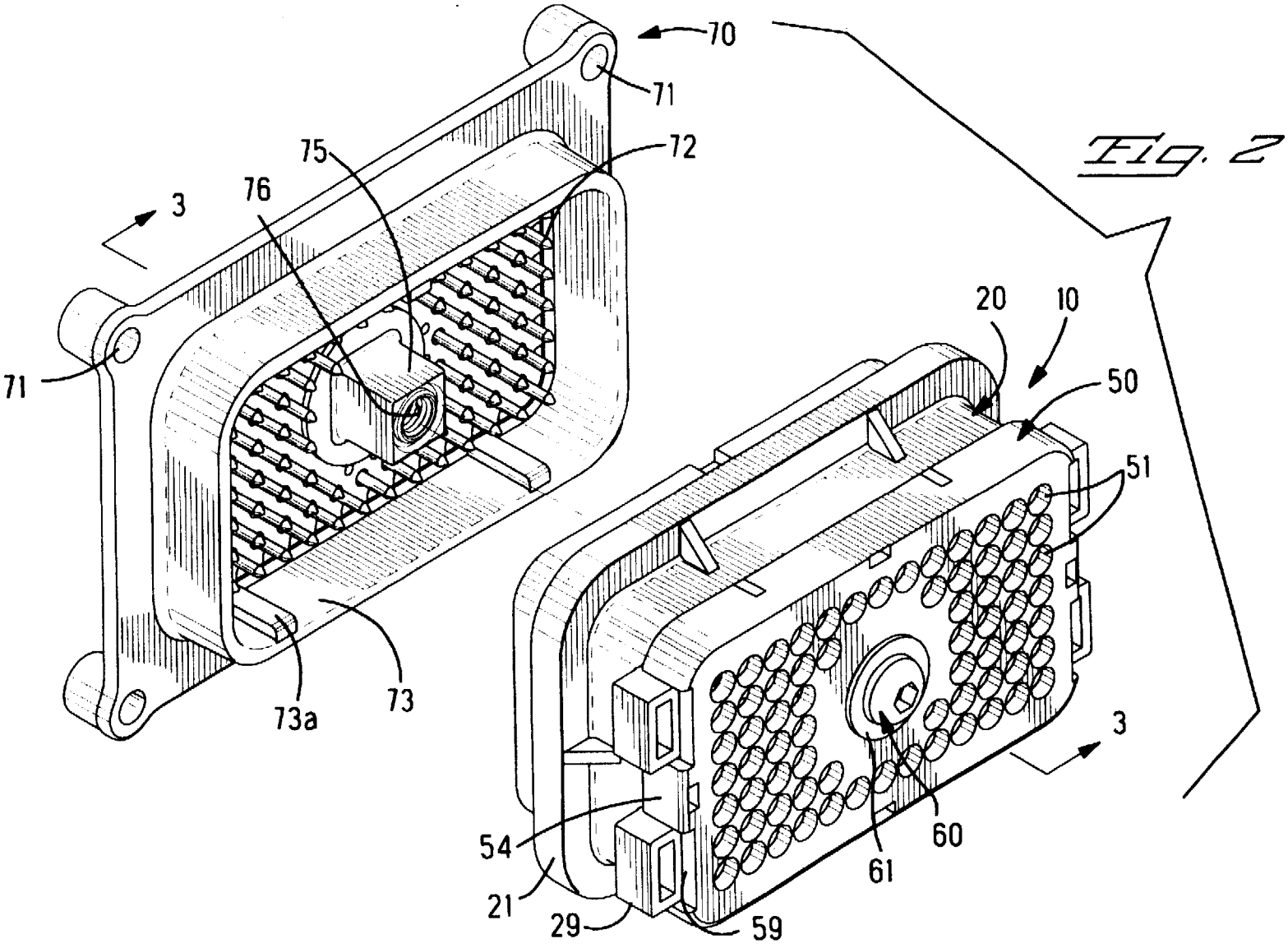
FIG. 2 shows the subassembly of FIG. 1 in a fully assembled state arranged to be connected to a matable connector comprising a contact pin array.
Figure 3:
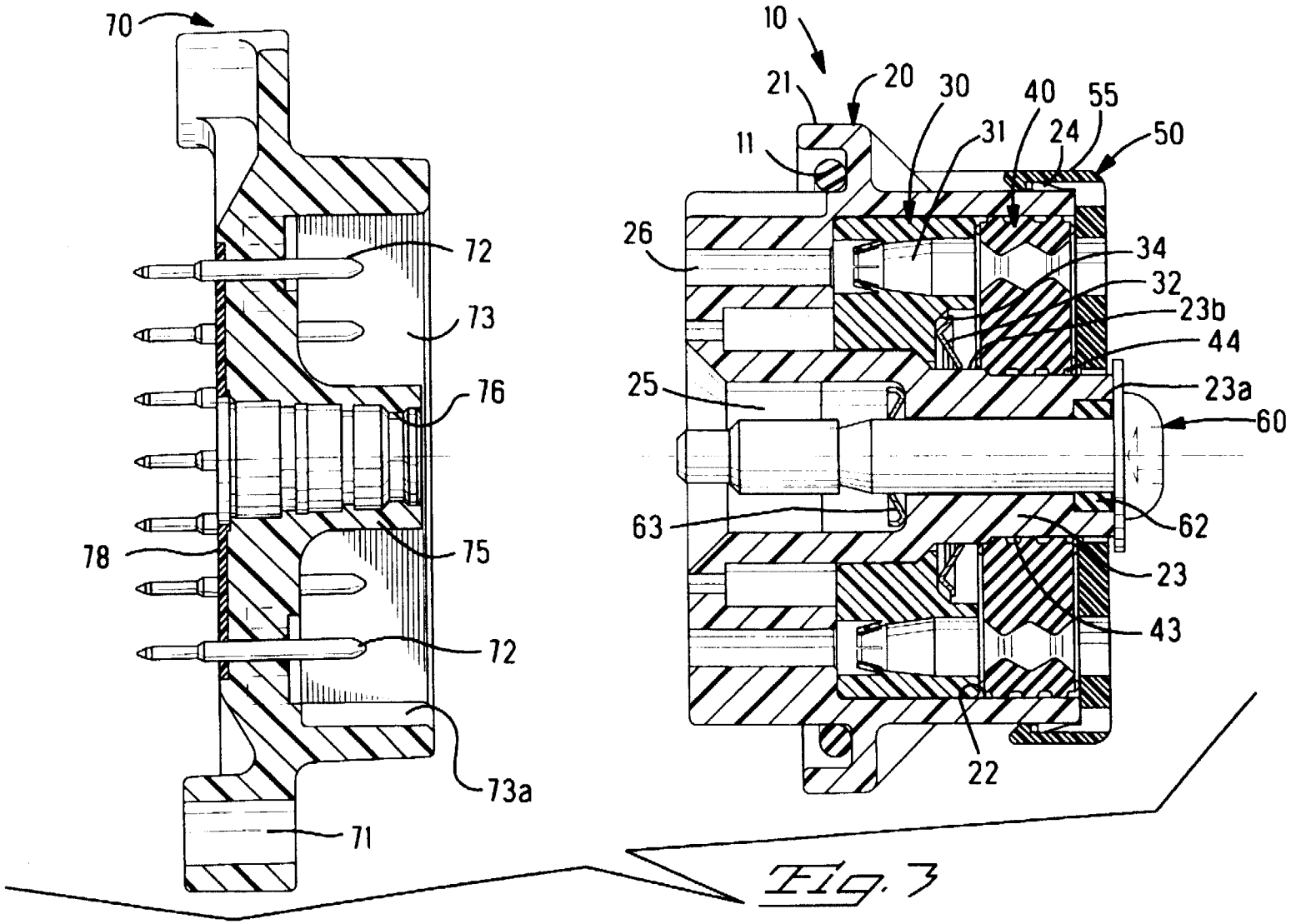
FIG. 3 shows a cross sectional view of the subassembly and header of FIG. 2 taken along line 3—3.
Figure 4:
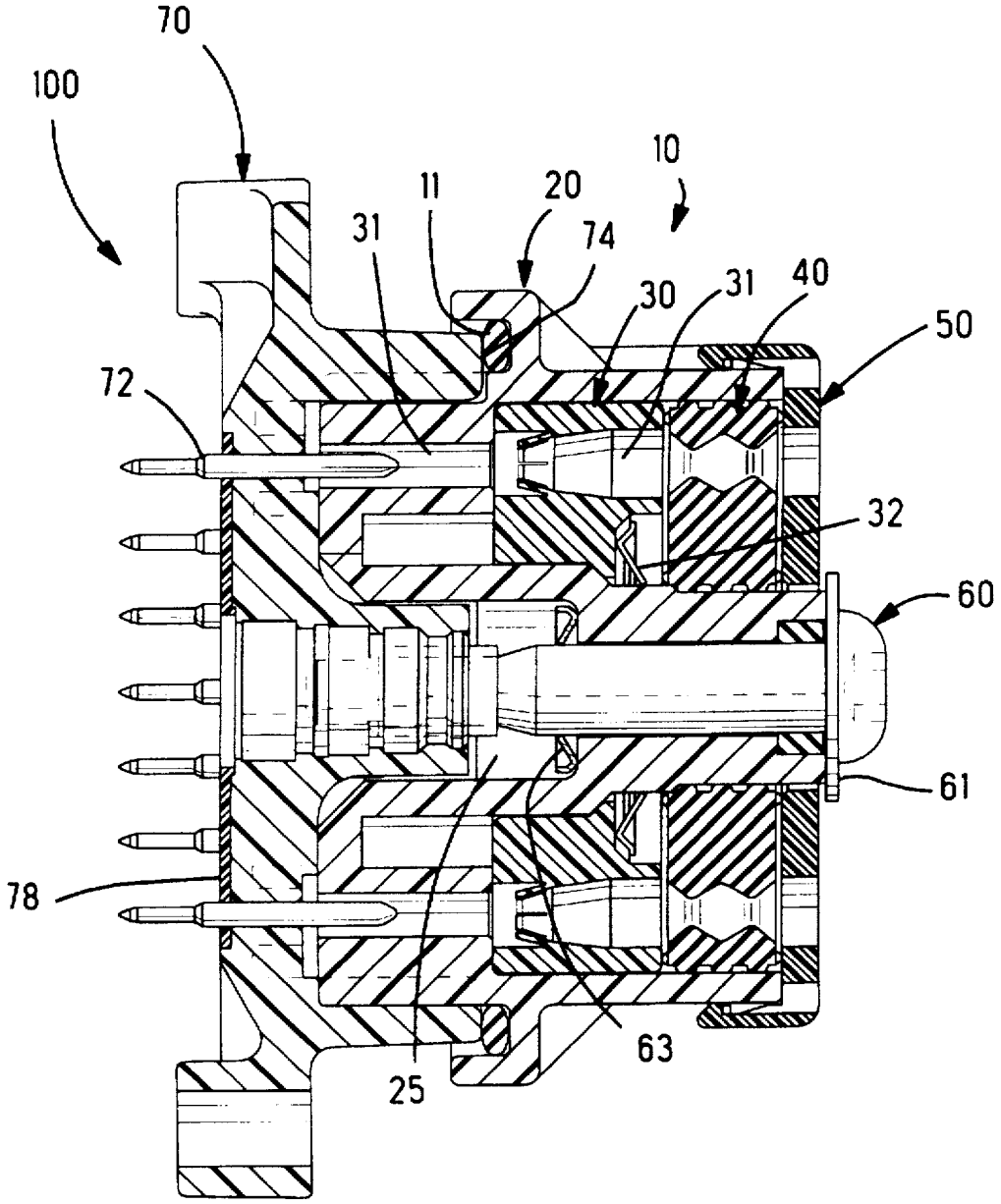
FIG. 4 shows a cross sectional view of the subassembly and header of FIG. 3 in a fully assembled state.

Referring to FIGS. 1–3, plug housing 20 includes: a seal receiving section 21 for receiving interface seal 11; a contact retention insert receiving cavity 22; a bolt tower 23 having a seal recess **23*a* for receiving bolt seal 62 therein; a friction surface 23*b* for frictionally receiving insert retaining clip 32 thereon; detents 24 on an outer surface thereof for receiving latches formed on the seal cover 50; a mating recess 25 for receiving a portion of header 70 (see FIG. 4); and pin receiving apertures 26 for receiving pins 72 of header 70 (see FIG. 4). Additionally, a plurality of wire guide mounts 29 are formed on an outer surface of plug housing 20 for receiving latching legs 89 of wire guide 80** (see FIG. 7).

Now referring to FIGS. 1, 3, and 4, contact retention insert 30 will be described. Contact retention insert 30 includes: contact receiving apertures 31 having latching fingers for latchable engagement with respective electrical contacts to be inserted therein; an insert retaining clip 32 having detents for biting into frictional surface **23*b* of bolt tower 23, and which clip advantageously retains the insert 30 within the cavity 22 of plug housing 20; a bolt tower receiving aperture 33 for receiving bolt tower 23 therethrough; and an insert clip flange 34 for pressing engagement with the insert retaining clip 32**.

Again referring to FIGS. 1, 3, and 4, wire seal 40 will be described. Seal 40 includes: contact receiving apertures 41; a bolt tower receiving aperture 43 having undulated surfaces for sealingly receiving bolt tower 23 therethrough; and sealing void spaces 44 allowing the seal to accommodate the bolt tower 23. Contact receiving apertures 41 include undulated surfaces for sealing engagement with conductors terminated to electrical contacts to be inserted in insert 30.

Referring to FIGS. 1–3, seal cover 50 is latchably mounted to housing 20. Seal cover 50 includes: contact receiving apertures 51; a bolt tower receiving aperture 53 for receiving bolt tower 23 therethrough; and side latches 54 and top latches 55 for latchably engaging latching detents 24 of plug housing 20 thereby retaining seal 40 within housing 20. Wire guide recesses 59 are provided for receipt of latching wire guide mounts 29 of housing 20, as is shown best in FIG. 5.

FIGS. 1, 3, and 4 best show the details of jack screw 60. Jack screw 60, as installed in assembly 10, cooperates with: a washer 61; a seal 62; and a retaining clip 63 for rotatably retaining jackscrew 60 in the plug housing 20. The jack screw 60 is rotatably mounted on the plug housing 20 but is axially locked in place between washer 61 and retaining clip 63. Retaining clip 63 allows rotational movement of the jack screw 60 relative to plug housing 20, but resists any axial displacement of the jackscrew 60 relative to plug housing 20.

Referring now to FIGS. 2–5, header housing 70 will be described. Header housing 70 includes: a plurality of mounting holes 71 for receiving fasteners for the purpose of mounting housing 70 to a component surface (not shown in the drawings); pin array 72 for electrical connection to contacts to be inserted in subassembly 10; and a cavity 73 for matably receiving the subassembly 10 therein. Additionally, polarizing ribs **73*a* are formed in cavity 73 for requiring proper polarization of subassembly 10 relative to the pin array 72. Header housing 70 further includes: a sealing face 74, as best shown in FIG. 4, for sealing engagement with interface seal 11; and a tower 75 including a threaded insert 76 for threadable engagement with jack screw 60. FIG. 4 also shows a silicone-base, UV light cured sealant material 78 layered around the pin array 72 for providing a seal interface on the component side of header 70**.

Figure 5:
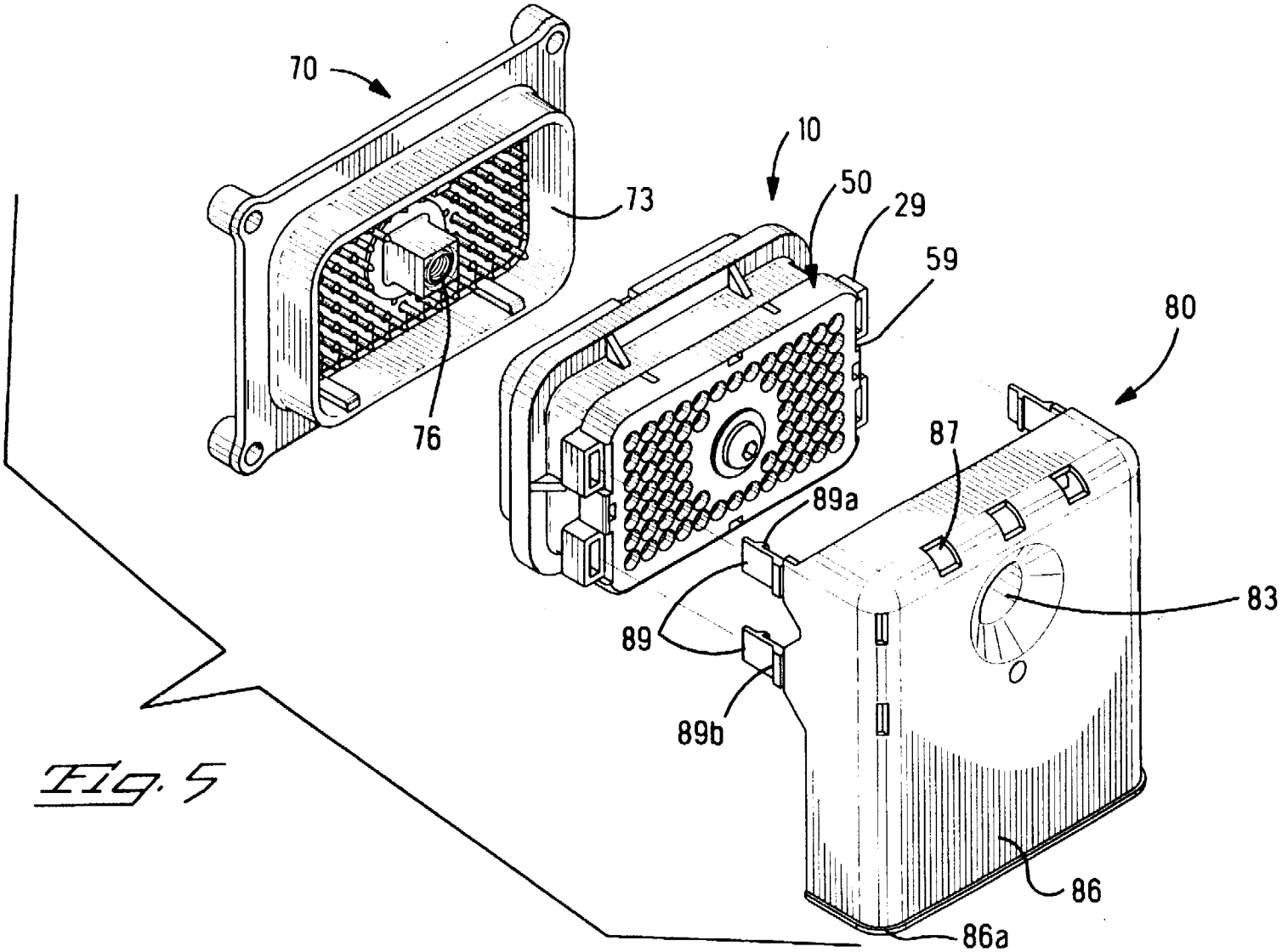
FIG. 5 shows an exploded isometric view of the subassembly and header of FIG. 2 with a wire guide member according to the present invention.
Figure 7:
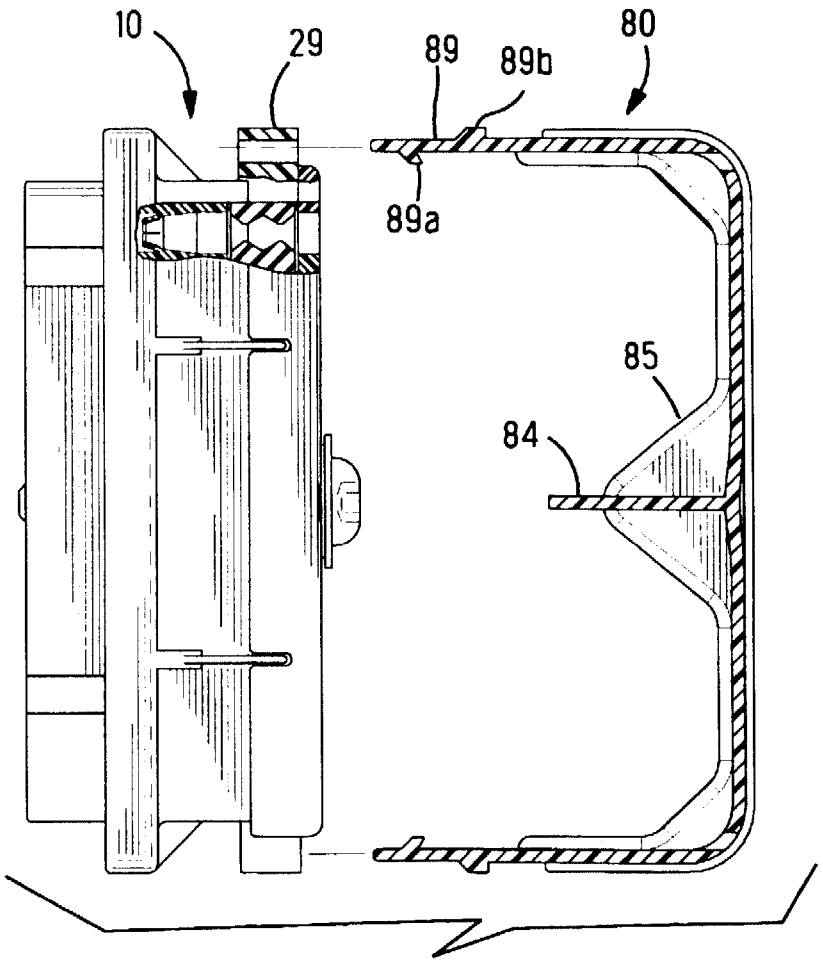
FIG. 7 shows a cross sectional view of the wire guide member of FIG. 6 arranged to be connected to the subassembly of the present invention.
Figure 6:
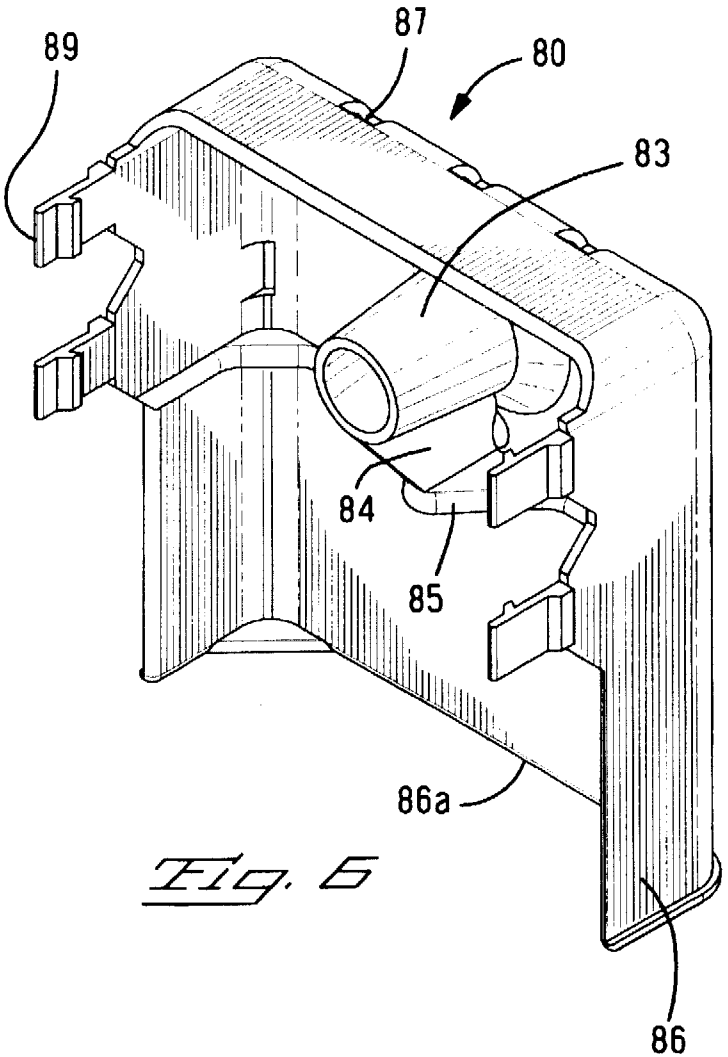
FIG. 6 shows an isometric view of the wire guide member of FIG. 5.

Referring to FIGS. 5–7, a wire guide 80 according to the present invention will be described. Wire guide 80 includes a bolt access tower 83 for a tool to have access to jack screw 60; and, as shown in FIGS. 6–7, wire guide 80 includes an intermediate reinforcement member 84 disposed between the tower 83 and a transverse reinforcement member 85. The reinforcement members serve the purpose of stiffening the wire guide 80, which stiffening is advantageous because the wire guide must pressingly guide a plurality of wires exiting from the subassembly 10 in order to minimize the space taken up by the wires in, for example, an engine compartment. Reinforcement members 84, 85 thus prevent buckling of the wire guide due to the pressing and guiding of the wires. Additionally, wire guide 80 comprises a lower section 86 thereby defining an extension of wire guide 80 for: protecting wires extending toward, for example, a braid of a wiring harness; preserving wire identification; and avoiding abrasion of wires exiting subassembly 10 by virtue of an edge radius profile **86*a*. Through holes 87** are provided for drainage of moisture or other contaminants from the wiring harness.

Referring to FIG. 7, latching legs 89 include front lugs **89*a* and back lugs 89*b* for latching engagement with wire guide mounts 29 of plug housing 20. Installation of wire dress 80 requires that respective lugs 89*a* will be inserted through respective guide mounts 29 so that respective lugs 89*b* will make an interference fit with guide mounts 29. Removal of cover 80 from subassembly 10 requires deflection of lugs 89*a* away from subassembly 10 so that lugs 89*a* are positioned to be retracted through guide mounts 29, and then cover 80 is pulled away from subassembly 10**.

FIG. 4 shows the overall mated assembly 100 without the wire guide 80. However, in a preferred embodiment with wire guide 80 installed on assembly 100, the wires will exit from the assembly 10 and will be generally oriented at a 90 degree angle relative to a mating axis of the subassembly 10.

Additionally, in the preferred embodiment of assembly 100, the contact retention insert 30 is inserted in cavity 22 of plug housing 20 and the insert retaining clip is pressed against the insert clip flange 34 so that the frictional detent members of insert retaining clip 32 will bite into the friction surface **23*b* of plug housing 20 thereby retaining the insert in the plug housing 20. It is notable, however, that friction surface 23*b* includes an outer diameter which is larger than the outer diameter of the bolt tower 23 adjacent to seal recess 23*a*, which facilitates installation of clip 32 as the inner diameter of the clip is sized to bite into only the larger diameter of surface 23*b*. Next, blanket-type wire seal 40 is inserted into cavity 22, and seal cover 50 is placed over the wire seal 40 so that latches 54, 55 engage cover detents 24, cover 50 thereby retains the seal 40 in cavity 22**.

Referring now to FIG. 4, an electrical contact (not shown) can be inserted into contact receiving aperture 31 so that the resilient fingers of aperture 31 will frictionally engage the electrical contact, and the pin array 72 will be aligned for electrical engagement with the contact. The operator then need only rotate jack screw 60 so that the header 70 will be drawn into mating engagement with subassembly 10. During this assembly step, electrical contacts in apertures 31 of subassembly 10 will be brought into electrical engagement with respective pins of contact pin array 72. With wires grouped accordingly, wire guide 80 will be aligned with the mated assembly 100, latching legs 89 of wire guide 80 will be inserted in wire guide mounts 29, and wire guide 80 will be pressed towards the mated assembly 100 thereby dressing the wires in a generally 90 degree angle relative to the mating axis of the mated assembly 100. As shown in FIG. 5, bolt access tower 83 of wire guide 80 will be aligned with jack screw 60 so that the operator may later have access for a tool to remove subassembly 10 from the header housing 70. An advantage of bolt access tower 83 is that jack screw 60, and bolt tower 23, need not be excessively long for tool access purposes, i.e. reach to the outer surface of the wire guide 80, because bolt access tower allows the tool to extend to the seal cover.

The foregoing invention: combines the advantages inherent in a blanket type seal 40 with a jack screw connector mating mechanism 60; securely retains electrical contacts in a contact retention insert 30; provides mechanical and electrical reliability of the electrical interconnections in the connector; and, by virtue of the retaining clip 32, is inexpensive to produce, and uses a minimum number of parts which can be quickly assembled with quality and reliability assured in the final assembly 100.

Thus, while a preferred embodiment of the invention has been disclosed, it is to be understood that the invention is not to be strictly limited to such embodiment, but may be otherwise variously embodied and practiced within the scope of the appended claims.

Accordingly, what is claimed is:

1. An electrical connector subassembly comprising:

(a) a housing with a housing cavity for receiving a contact retention insert therein, and a tower section;

(b) a contact retention insert disposed in said housing cavity, said retention insert comprises at least one electrical contact receiving cavity therein, and said retention insert comprises an aperture, said tower extends through said aperture; and (c) a retaining part is mounted in said housing cavity for contact with said contact retention insert, and a section of said retaining part engages a portion of said tower for retaining said insert in said housing cavity.

2. The subassembly of claim 1, wherein said retaining part comprises an annular ring.

3. The subassembly of claim 1, wherein said retaining part comprises detents for said engagement.

4. The subassembly of claim 1, wherein said tower is integral with said housing.

5. The subassembly of claim 1, wherein said contact retention insert comprises a recess which receives said retaining part therein.

6. The subassembly of claim 5, wherein said recess includes a bearing surface for supporting said retaining part.

7. The subassembly of claim 1, wherein said tower comprises a fastener retaining member in a recess thereof.

8. The subassembly of claim 7, wherein said fastener retaining member is disposed radially inwardly relative to said retaining part about said tower.

9. The subassembly of claim 1, wherein said tower comprises a fastener sealing member in a recess thereof.

10. The subassembly of claim 9, wherein said fastener sealing member is disposed radially inwardly relative to said retaining part about said tower.

11. An electrical connector subassembly comprising:

(a) a housing for receiving a contact retention insert, and said housing includes a tower section;

(b) a contact retention insert, said retention insert comprises at least one electrical contact receiving cavity therein, and said retention insert comprises an aperture, said tower extends through said aperture; and (c) a retaining part is mounted adjacent to said contact retention insert, and a section of said retaining part engages a portion of said tower for retaining said contact retention insert with said housing.

12. The subassembly of claim 11, wherein said retaining part comprises an annular ring.

13. The subassembly of claim 11, wherein said retaining part comprises detents for said engagement.

14. The subassembly of claim 11, wherein said tower is integral with said housing.

15. The subassembly of claim 11, wherein said contact retention insert comprises a recess which receives said retaining part therein.

16. The subassembly of claim 15, wherein said recess includes a bearing surface for supporting said retaining part.

17. The subassembly of claim 11, wherein said tower comprises a fastener retaining member in a recess thereof.

18. The subassembly of claim 17, wherein said fastener retaining member is disposed radially inwardly relative to said retaining part.

19. The subassembly of claim 11, wherein said tower comprises a fastener sealing member in a recess thereof.

20. The subassembly of claim 19, wherein said fastener sealing member is disposed radially inwardly relative to said retaining part.

* * * * *